US008756894B2

(12) United States Patent
Swartz et al.

(10) Patent No.: US 8,756,894 B2
(45) Date of Patent: Jun. 24, 2014

(54) FOLDABLE CONSTRUCTION BLOCKS

(75) Inventors: Robert Swartz, Highland Park, IL (US); Joseph Fallon, Oak Forest, IL (US); Robert McClure, Benson, AZ (US)

(73) Assignee: Impossible Objects LLC, Northbrook, IL (US)

( * ) Notice: Subject to any disclaimer, the term of this patent is extended or adjusted under 35 U.S.C. 154(b) by 163 days.

(21) Appl. No.: 13/033,904

(22) Filed: Feb. 24, 2011

(65) Prior Publication Data

US 2011/0206872 A1 Aug. 25, 2011

Related U.S. Application Data

(60) Provisional application No. 61/308,247, filed on Feb. 25, 2010.

(51) Int. Cl.

| | |
|---|---|
| ***E04C 2/32*** | (2006.01) |
| ***E04C 2/00*** | (2006.01) |
| ***A63H 33/08*** | (2006.01) |
| ***A63H 33/04*** | (2006.01) |

(52) U.S. Cl.

USPC ..... 52/604; 52/574; 52/582.1; 52/603; 446/109; 446/122

(58) Field of Classification Search

CPC ..... A63H 33/062; A63H 33/04; A63H 33/08; A63H 33/086; A63H 33/088

USPC ..... 52/603, 271, 284, 394, 574, 582.1, 52/585.1, 586.1, 588.1, 604, 608, DIG. 10; 446/109, 112, 113, 114, 115, 122, 124, 446/125; 428/33

See application file for complete search history.

(56) References Cited

U.S. PATENT DOCUMENTS

| | | | | | |
|---|---|---|---|---|---|
| 101,179 | A | * | 3/1870 | Swift | 446/122 |
| 1,182,980 | A | * | 5/1916 | Converse | 446/121 |
| 1,237,728 | A | | 8/1917 | Tuck | |
| 1,292,188 | A | * | 1/1919 | Wheeler | 446/85 |
| 1,314,541 | A | | 9/1919 | Seeger | |
| 1,642,901 | A | | 9/1927 | Srofe | |
| 1,689,107 | A | * | 10/1928 | Bradley | 52/592.3 |
| 2,131,349 | A | | 9/1938 | Kreider | |
| 2,751,705 | A | | 6/1956 | Joseph | |
| 3,005,282 | A | | 10/1961 | Christiansen | |
| 3,234,682 | A | * | 2/1966 | Frankl | 446/85 |
| 3,305,982 | A | * | 2/1967 | Steele | 52/90.1 |

(Continued)

FOREIGN PATENT DOCUMENTS

| | | | | |
|---|---|---|---|---|
| GB | 506204 | A | * | 5/1939 |
| GB | 996811 | A | * | 6/1965 |
| GB | 1382134 | A | * | 1/1975 |
| WO | WO 2008051046 | A1 | * | 5/2008 |

*Primary Examiner* — Basil Katcheves
*Assistant Examiner* — Rodney Mintz

(57) ABSTRACT

In an exemplary embodiment of this invention, corrugated board is folded into a building system. The building system comprises a plurality of blocks and connectors. The blocks are rectangular cuboid in shape. The bottom and top sides of the blocks have rectangular arrays of holes. The blocks may be releasably connected by aligning the top holes of one block with the bottom holes of another block, and then inserting connectors into the aligned pairs of holes, one connector per aligned paid of holes. The ends of the connectors that are inserted are circular or equiangular polygonal in shape. In some embodiments, compression is used to releasably hold the connectors in place.

4 Claims, 11 Drawing Sheets

(56) References Cited

U.S. PATENT DOCUMENTS

| | | | | | |
|---|---|---|---|---|---|
| 3,368,316 | A | | 2/1968 | Crowder | |
| 3,391,824 | A | * | 7/1968 | Wiseman | 206/504 |
| 3,566,531 | A | | 3/1971 | Hasel | |
| 3,581,431 | A | | 6/1971 | Trenovan | |
| 3,618,279 | A | * | 11/1971 | Sease | 52/223.7 |
| 3,659,360 | A | * | 5/1972 | Zeischegg | 434/403 |
| 3,663,346 | A | * | 5/1972 | Schoen | 428/116 |
| 3,663,347 | A | * | 5/1972 | Schoen | 428/116 |
| 3,665,669 | A | | 5/1972 | Huber | |
| 3,666,607 | A | * | 5/1972 | Weissman | 428/33 |
| 3,670,449 | A | * | 6/1972 | Lemkin et al. | 446/102 |
| 3,702,520 | A | | 11/1972 | Huber | |
| 3,774,339 | A | * | 11/1973 | Swett | 446/121 |
| 3,894,354 | A | | 7/1975 | Crawley | |
| 3,895,229 | A | * | 7/1975 | Strom | 362/351 |
| 3,985,285 | A | * | 10/1976 | Kitagawa | 229/103.3 |
| 4,007,555 | A | * | 2/1977 | Sasaoka | 446/127 |
| D250,898 | S | * | 1/1979 | Schuring | D25/113 |
| 4,172,549 | A | * | 10/1979 | Yoshida | 229/116.1 |
| 4,254,574 | A | | 3/1981 | Stock | |
| 4,258,479 | A | * | 3/1981 | Roane | 434/211 |
| 4,380,133 | A | * | 4/1983 | Arnstein | 446/488 |
| 4,429,506 | A | * | 2/1984 | Henderson | 52/591.1 |
| 4,608,799 | A | | 9/1986 | Hasegawa | |
| 4,620,842 | A | * | 11/1986 | Wang | 434/135 |
| 4,681,481 | A | * | 7/1987 | Kapusta | 404/34 |
| 4,723,382 | A | * | 2/1988 | Lalvani | 52/81.1 |
| 4,925,338 | A | * | 5/1990 | Kapusta | 404/41 |
| 4,965,106 | A | | 10/1990 | DeChristopher | |
| 4,976,652 | A | * | 12/1990 | Schwartz | 446/488 |
| 5,036,635 | A | * | 8/1991 | Lalvani | 52/80.1 |
| 5,107,653 | A | * | 4/1992 | Lewis | 52/591.1 |
| 5,125,867 | A | | 6/1992 | Solomon | |
| 5,155,951 | A | * | 10/1992 | Lalvani | 52/80.2 |
| 5,162,010 | A | | 11/1992 | Krebs | |
| 5,169,352 | A | * | 12/1992 | Petersen | 446/85 |
| 5,230,195 | A | * | 7/1993 | Sease | 52/592.6 |
| 5,253,799 | A | * | 10/1993 | Sebesta | 229/108 |
| 5,281,185 | A | | 1/1994 | Lee | |
| 5,402,609 | A | * | 4/1995 | Kelley, Jr. | 52/98 |
| 5,458,495 | A | * | 10/1995 | Stone | 434/403 |
| 5,489,230 | A | * | 2/1996 | Gavula, Jr. | 446/109 |
| 5,493,816 | A | * | 2/1996 | Willemsen | 52/2.11 |
| 5,597,112 | A | * | 1/1997 | Knapp | 229/116 |
| 5,662,508 | A | | 9/1997 | Smith | |
| D387,431 | S | * | 12/1997 | Tremblay | D25/113 |
| 5,791,554 | A | * | 8/1998 | Jensen | 229/148 |
| 5,928,051 | A | | 7/1999 | Krog | |
| 5,987,840 | A | * | 11/1999 | Leppert | 52/592.6 |
| 6,152,797 | A | * | 11/2000 | David | 446/115 |
| 6,179,681 | B1 | * | 1/2001 | Matos | 446/116 |
| 6,371,823 | B1 | * | 4/2002 | Stavran | 446/128 |
| D457,971 | S | * | 5/2002 | Schrader et al. | D25/113 |
| D468,839 | S | * | 1/2003 | Bland | D25/113 |
| 6,641,452 | B2 | * | 11/2003 | Racine | 446/122 |
| 6,643,961 | B1 | * | 11/2003 | Hluchan | 40/492 |
| 6,895,722 | B1 | * | 5/2005 | Ponder | 52/578 |
| 6,996,945 | B2 | * | 2/2006 | Doty | 52/585.1 |
| 6,997,771 | B1 | * | 2/2006 | Lucier | 446/108 |
| 7,018,690 | B2 | * | 3/2006 | Lee | 428/36.5 |
| 7,625,261 | B2 | | 12/2009 | Andersen | |
| 7,806,038 | B2 | * | 10/2010 | Duke | 89/36.04 |
| 8,047,889 | B2 | * | 11/2011 | Ishii | 446/85 |
| 8,256,168 | B2 | * | 9/2012 | Bigger | 52/79.2 |
| 8,286,402 | B2 | * | 10/2012 | Fleishman | 52/588.1 |
| 8,296,981 | B1 | * | 10/2012 | Gardinier et al. | 40/605 |
| D670,767 | S | * | 11/2012 | Ezra et al. | D21/499 |
| 8,382,398 | B2 | * | 2/2013 | Stauffacher et al. | 405/111 |
| D683,055 | S | * | 5/2013 | Nanayakkara | D25/113 |
| 8,544,216 | B1 | * | 10/2013 | Hazlett | 52/79.5 |
| 8,567,149 | B2 | * | 10/2013 | Kuzmin | 52/592.1 |
| 2002/0078653 | A1 | * | 6/2002 | Jean | 52/578 |
| 2002/0168916 | A1 | * | 11/2002 | Axelrad | 446/109 |
| 2002/0187720 | A1 | * | 12/2002 | Engle | 446/85 |
| 2004/0226246 | A1 | * | 11/2004 | Doty | 52/503 |
| 2004/0250494 | A1 | * | 12/2004 | Osiatinskiy et al. | 52/582.1 |
| 2007/0163010 | A1 | * | 7/2007 | Ishii | D21/484 |
| 2007/0228127 | A1 | * | 10/2007 | Gardner | 229/122.23 |
| 2008/0263986 | A1 | * | 10/2008 | Cables | 52/574 |
| 2009/0117311 | A1 | * | 5/2009 | Kuzmin | 428/44 |
| 2010/0078985 | A1 | * | 4/2010 | Mahoney et al. | 297/446.1 |
| 2010/0147839 | A1 | * | 6/2010 | Pasi | 220/6 |
| 2010/0178839 | A1 | * | 7/2010 | Khattah Omar | 446/120 |
| 2011/0036040 | A1 | * | 2/2011 | Child | 52/588.1 |
| 2011/0107706 | A1 | * | 5/2011 | Fleishman | 52/574 |
| 2012/0240463 | A1 | * | 9/2012 | Bindschedler et al. | 47/65.7 |
| 2012/0291383 | A1 | * | 11/2012 | Zohar | 52/309.1 |
| 2013/0080286 | A1 | * | 3/2013 | Rotholz | 705/26.5 |
| 2013/0165013 | A1 | * | 6/2013 | Chin | 446/124 |
| 2013/0171431 | A1 | * | 7/2013 | Swartz et al. | 428/196 |
| 2013/0210315 | A1 | * | 8/2013 | Hohrmann Pedersen | 446/124 |
| 2013/0212970 | A1 | * | 8/2013 | Santoro | 52/572 |
| 2013/0217295 | A1 | * | 8/2013 | Karunaratne | 446/124 |
| 2013/0330998 | A1 | * | 12/2013 | Fox et al. | 446/124 |
| 2013/0330999 | A1 | * | 12/2013 | Ryaa | 446/124 |

* cited by examiner

FOLDABLE CONSTRUCTION BLOCKS

RELATED APPLICATIONS

This application claims the benefit of United States Provisional Application Ser. No. 61308247, filed Feb. 25, 2010, the entire disclosure of which is herein incorporated by reference.

FIELD OF THE TECHNOLOGY

The present invention relates generally to building blocks.

BACKGROUND

A variety of existing building blocks can be made by folding a sheet of cardboard. For example, blocks of this type have been disclosed in U.S. Pat. Nos. 3,665,669, 3,702,520, 4,608,799, 5,125,867, 5,281,185 and 5,662,508. In each case, the blocks are stackable and may be releasably interconnected. However, each of these blocks has problems, as discussed below.

In U.S. Pat. No. 3,665,669, each building block has two tabs, aligned in a single line, that protrude from an edge of one side of the block, and also has two slots on an opposite side of the block. Interconnections are formed by inserting the tabs of one block into the slots of one or two other blocks. These interconnections allow a straight wall to be built, but do not allow a corner to be built in which tabs from blocks in one wall are inserted into slots of blocks from another wall. U.S. Pat. No. 3,702,520 is similar, but better able to handle corners. Each block may be folded in such a way as to provide either two tabs in a row down the center line of the block (for making a straight wall) or three tabs, one of which is aligned with the center line of the block and two of which are transverse to the center line (for making a corner). However, the blocks disclosed by both of these patents have problems. First, the connections are not sufficiently rigid. For example, this lack of rigidity makes the blocks impractical for use in many cantilevers or other structures that put substantial torque on an unsupported end of a block. Second, the tabs do not wear well when repeated insertion and release of the tabs occurs. Third, the blocks may be used only for making a straight run of a wall (or, in some cases, a corner). For example, two blocks may not be connected in the shape of a "T" or a cross.

In U.S. Pat. No. 5,662,508, a block has four semicircular tabs, each protruding from the top of the block, with two tabs in a line on one edge of the top and two tabs in a line on an opposite edge of the top. Each block also has a total six semicircular holes on its sides, each at the bottom of a side, with two holes on each long side and one hole on each short side. Each block also has a slot at the center of the bottom side, running transverse to the long axis of the block. An interconnection between two blocks that are aligned in parallel may be formed by inserting semicircular tabs of one block into semicircular holes of another block, and then bending the tabs to releasably lock them in place. An interconnection between two blocks that are transverse to each other may be formed by inserting a semicircular tab of one block into a center slot of another block. These blocks, however, suffer from each of the same problems as U.S. Pat. Nos. 3,665,609 and 3,702,520, discussed above. In addition, the semicircular holes detract from the appearance of the block. For example, a wall made of these blocks would have numerous semicircular holes in it.

In U.S. Pat. No. 4,254,574, each block has a polygonal raised rim on one side and a polygonal hole on an opposite side. Interconnections are made by inserting a raised rim of one block into a hole of another block. These blocks, however, suffer from each of the same problems as U.S. Pat. Nos. 3,665,609 and 3,702,520.

The above patents do not disclose how to fold cardboard in such a manner as to form multiple, parallel rows of protuberances on a single side of a block. Multiple rows of protuberances (similar to a basic Lego® plastic brick) are desirable because they allow for a more rigid interconnection between two blocks.

In U.S. Pat. Nos. 4,608,799, 5,125,867 and 5,281,185, the blocks are made from a semi-rigid material such as cardboard. They have slots or holes into which connectors are inserted. The connectors are separate from the blocks, and made of a different material, such as plastic. The connectors come in a variety of shapes (depending on the patent), such as flat connectors that are circular, semicircular, or rectangular, flat connectors that are polygonal with teeth, or conical connectors with flanges. However, the interconnections (and in particular, the apertures such as slots or holes) do not wear well when subjected to repeated insertion and release.

In all six of the above patents, the manner of interconnection is not similar to that of a Lego® plastic bricks. This is a disadvantage, because end users must be instructed on how to interconnect the blocks.

SUMMARY

In an exemplary implementation of this invention, rectangular construction blocks may be made by folding flat sheets of cardboard. The blocks are stackable.

In this implementation of the invention, the blocks may be releasably attached to each other with connectors. Each connector is formed by folding a separate, flat cardboard sheet into a quadrilateral pyramid whose top is truncated. A connector is firmly retained in place in a block as follows: When a building block is folded into shape, the building block partially encloses the pyramidal connector. The base and a thicker bottom portion of the connector are inside the block. A smaller top, truncated portion of the pyramidal connector protrudes through a hole in a side of the block. This top portion of the connector appears as a nub (protuberance) on the side of the building block through which it protrudes.

In this implementation of the invention, a connector is rigidly attached to the building block in which it is partially enclosed. The connector cannot move lengthwise along its axis because, on the one hand, the tapered shape of the pyramidal connector prevents the larger base of the connector from protruding further out through the hole in the side of the block, and, on the other hand, the inner side of a wall of the building block prevents the connector from moving further into the block. Side to side movement of the connector (or rotation about its axis) is prevented by the square shape of the hole through which the pyramidal connector snugly protrudes.

In this implementation of the invention, a side of a building block may have a single nub, a single row of nubs, or multiple parallel rows of nubs, similar to Lego® plastic bricks. As discussed above, a nub is the top, truncated portion of a pyramidal connector that protrudes through a hole in the side of the building block (the connector being partially enclosed by the building block).

In this implementation of the invention, building blocks may be connected by inserting nubs of one block into apertures in one or more other blocks. These apertures are square. In each aperture are four triangular tabs, formed by cutting an X shape comprised of two lines, each of which runs from a corner of the square aperture to an opposite corner of the square aperture. When the tabs are "down" (i.e., aligned with the surface of the block side from which they are cut), the only openings in the aperture appear to be the two slots that form an X. When the tabs are pushed "up" (i.e. bent so that they are at a sharp angle from the block side from which they are cut), the aperture appears as a square hole.

In this implementation of the invention, if a building block has multiple parallel rows of nubs on one side, then it has multiple parallel rows of square apertures on an opposite side. If a building block has only one row of nubs on a side, then it has only one row of square apertures on the opposite side.

In this implementation of the invention, the problems of the prior art described above are solved. First, highly rigid connections between blocks are formed, enabling the building blocks to maintain their position relative to each other despite torque or other forces, such as typically encountered in a cantilever. Second, the connectors and the apertures into which they are inserted wear well, even after being repeatedly connected and unconnected. Third, the building blocks may have multiple parallel rows of nubs on a single side. Fourth, the nubs and apertures allow the building blocks to be connected in a wide variety of shapes, in addition to merely forming a wall or corner. For example, two blocks may be connected in the shape of a T or the shape of cross, or indeed, in any shape that basic Lego® plastic bricks may be connected. Fifth, when the blocks are assembled as a wall, there are no holes (into which connectors may be inserted) visible from the side, and thus the wall is more attractive in appearance.

In this implementation of the invention, the general functionality of the building blocks is similar to a basic Lego® plastic brick. This is advantageous, because a person who knows how to use Lego® plastic bricks will know how to connect these cardboard building blocks without any instruction.

However, due to differences in materials, the actual mechanism used to achieve rigid but releasable connection is quite different. A Lego® plastic brick is composed of acrylonitrile butadiene styrene (ABS). When two Lego® bricks are snapped together, the ABS elastically deforms, and when they are snapped apart, the ABS returns to its prior position without permanent deformation. In contrast, in this implementation of the invention, the building blocks are made of cardboard. Cardboard tends to tear, fray or permanently deform much more easily than ABS. As a result, the interlocking mechanism used in a plastic Lego® brick cannot be used in a cardboard building block. In an exemplary implementation of this invention, a novel interlocking arrangement comprised of three layers of cardboard is employed, as described below.

The above description of the present invention is just a summary. It is intended only to give a general introduction to some illustrative implementations of this invention. It does not describe all of the details of this invention. This invention may be implemented in many other ways.

BRIEF DESCRIPTION OF THE DRAWINGS

In the detailed description of the invention, reference will be made to the following drawings:

FIG. 10A shows the bottom of the block with two holes in it; FIG. 10B shows the top of the block with two protuberances on it.

The above Figures illustrate some illustrative implementations of this invention, or provide information that relates to those implementations. However, this invention may be implemented in many other ways. The above Figures do not show all of the details of this invention.

DETAILED DESCRIPTION

In an exemplary implementation of this invention, a building block may be made by folding a flat shape of corrugated card. Cardboard is a desirable material because it is lightweight and inexpensive. The light weight and low cost makes it practicable to make large blocks. Flat sheets of cardboard may be shipped to the end user, and then folded by the end user.

In this implementation of the invention, the blocks are stackable and may be releasably attached to each other. The attachments are rigid enough that large stable structures may be made, and that cantilevered shapes, or other shapes subject to significant torque, may be used.

Advantageously, this invention may be implemented as a building block made from folded cardboard that is similar in general functionality to existing Lego® plastic bricks. This is desirable, because it allows a user who is familiar with Lego® plastic bricks to use the building block without instruction.

Existing Lego® plastic bricks come in a variety of shapes. For example, they may two parallel rows of nubs (projections or protuberances) on the top side, or just a single row of nubs, or just a single nub.

Figure 1:
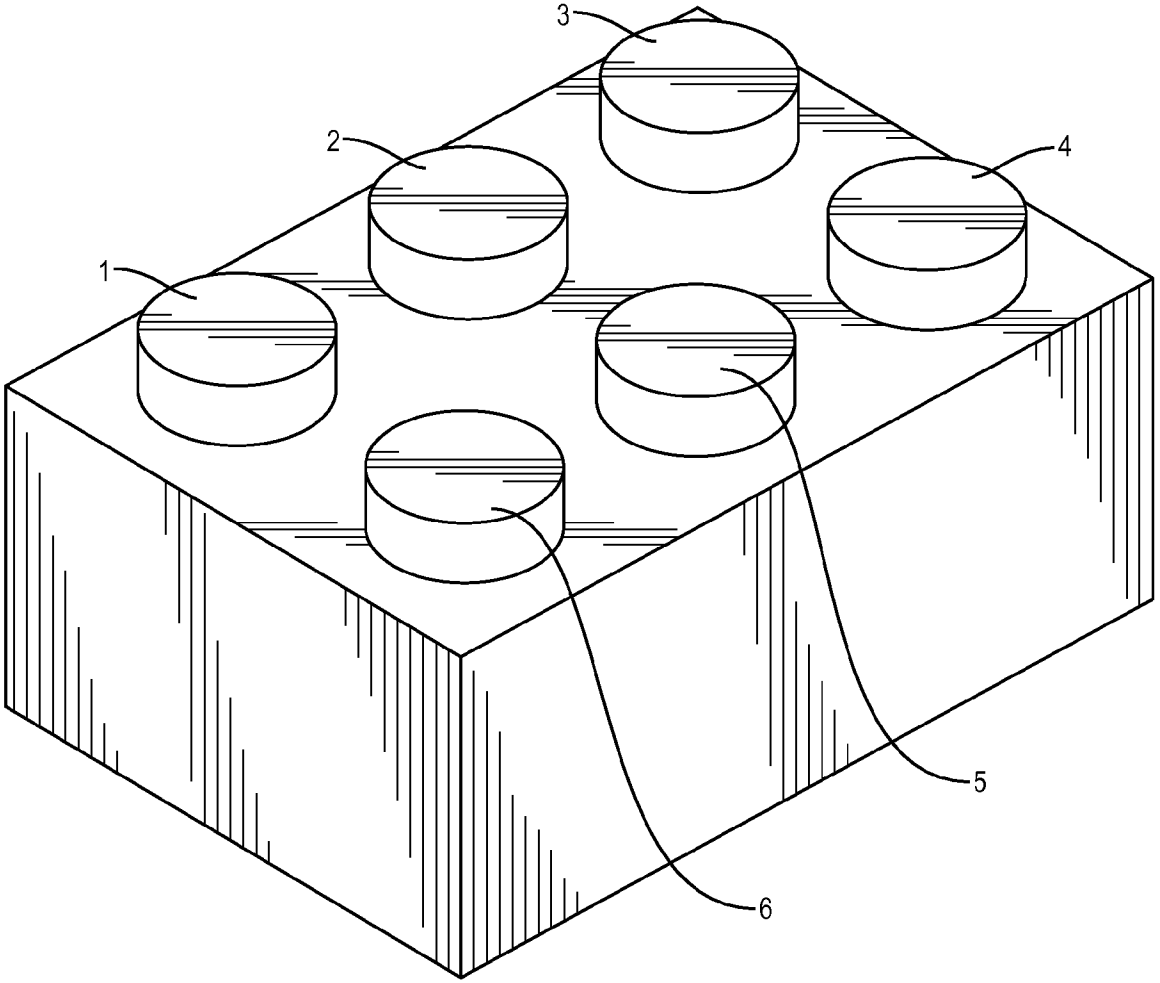
FIG. 1 (PRIOR ART)
FIG. 1 is an orthographic view of the top and two sides of a prior art Lego® plastic brick.

FIG. 1 is an orthographic view of the top and two sides of a prior art Lego® plastic brick, with two parallel rows of three nubs each on the top side of the brick. Thus, there are a total of six nubs 1-6 on the top side of the brick.

Figure 2:
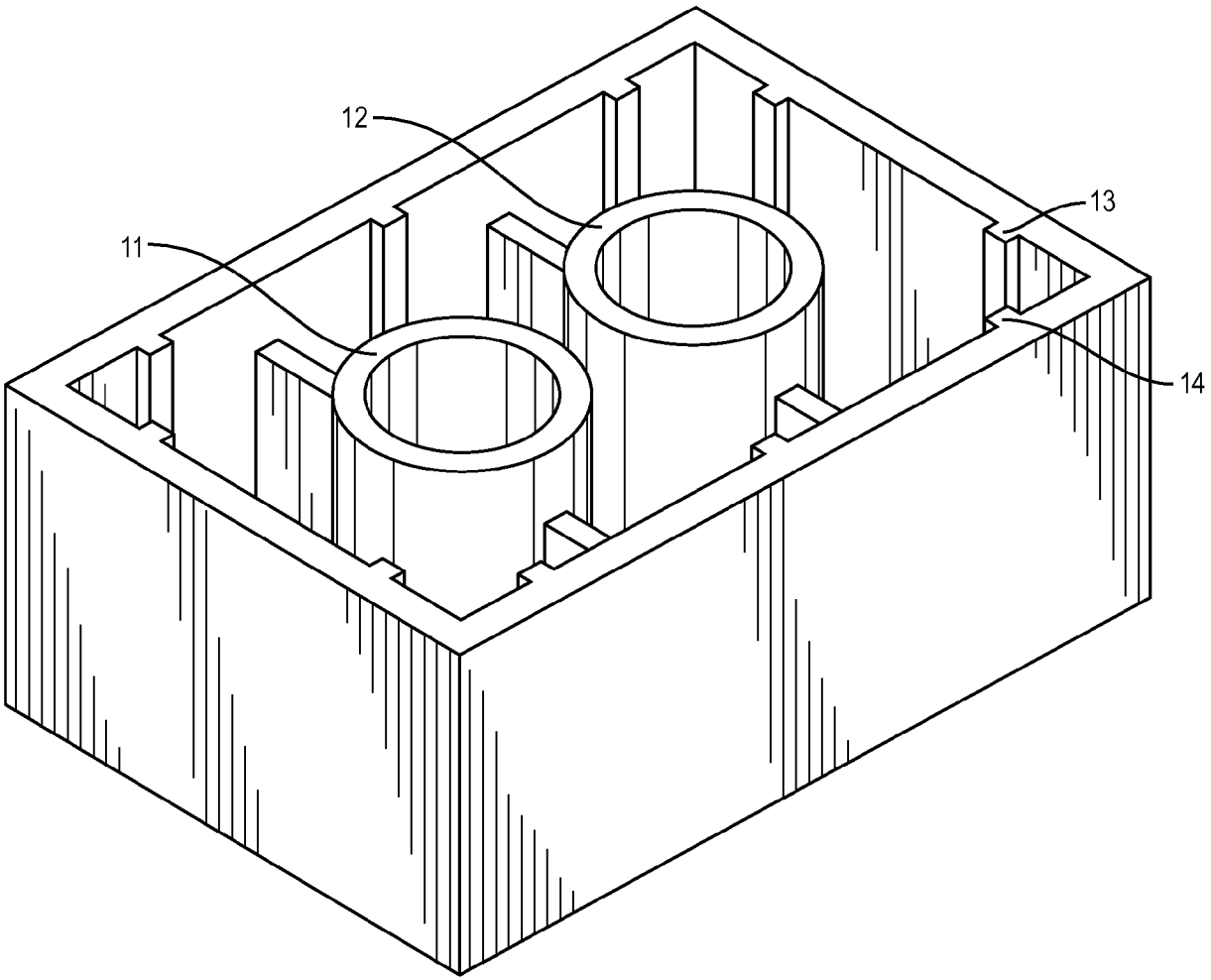
FIG. 2 (PRIOR ART)
FIG. 2 is an orthographic view of the bottom and two sides of a prior art Lego® plastic brick.

FIG. 2 is an orthographic view of the bottom and two sides of a prior art Lego® plastic brick. In order to releasably attach two such Lego® bricks to each other, the six nubs 1-6 of one block are inserted into openings in the bottom of another block. The nubs do not go into the central tubes 11 and 12 of the bottom. Rather, each nub is inserted into a hole defined by the exterior of a tube and a corner of the brick, or by the exterior of two tubes and a side of the brick. One such hole is defined by tube 12 and two ridges 13 and 14 in a corner of the brick.

Existing Lego® plastic brick are composed of acrylonitrile butadiene styrene (ABS) plastic. This resilient plastic elastically deforms when the nubs are inserted into the holes, and then springs back into place when the nubs are removed.

However, cardboard tears, frays and permanently deforms more easily than ABS plastic. Thus, for a building block made of folded cardboard, the same interlocking mechanism would not be practical. If the tube 12 and two ridges 13 and 14 were made of cardboard, they would tear or permanently deform very quickly, thereby destroying the interlocking mechanism.

In illustrative embodiments of this invention, the building blocks have a general functionality similar to that of Lego® plastic bricks, but have a different interlocking approach. In these embodiments, the interlocking mechanism is well suited for cardboard. For example, a novel interlocking approach may be used which involves three layers of cardboard pressed together.

Figure 3:
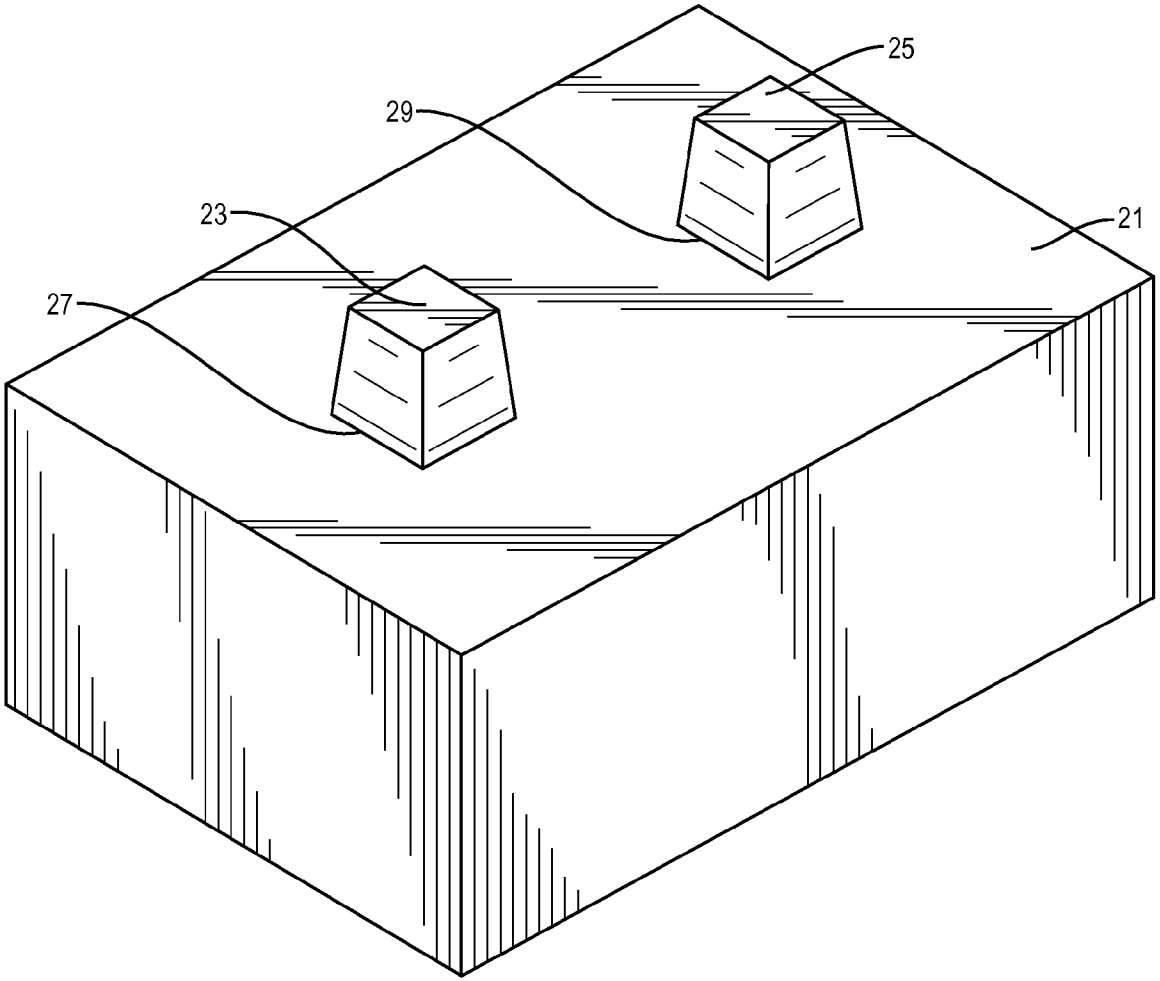
FIG. 3 is an orthographic view of the top and two sides of a building block, in an implementation of this invention.

FIG. 3 is an orthographic view of the top and two sides of a building block, in an exemplary implementation of this invention. The block is made by folding a flat cardboard shape. Two nubs 23, 25 project upward through two holes 27, 29 in the top side 21 of the block. Each nub is part of a connector. Each connector is partially enclosed in the block when the block is folded into shape. Each connector is generally quadrilateral pyramidal in shape. The top, projecting portion of the connectors are the nubs 23, 25.

Figure 4:
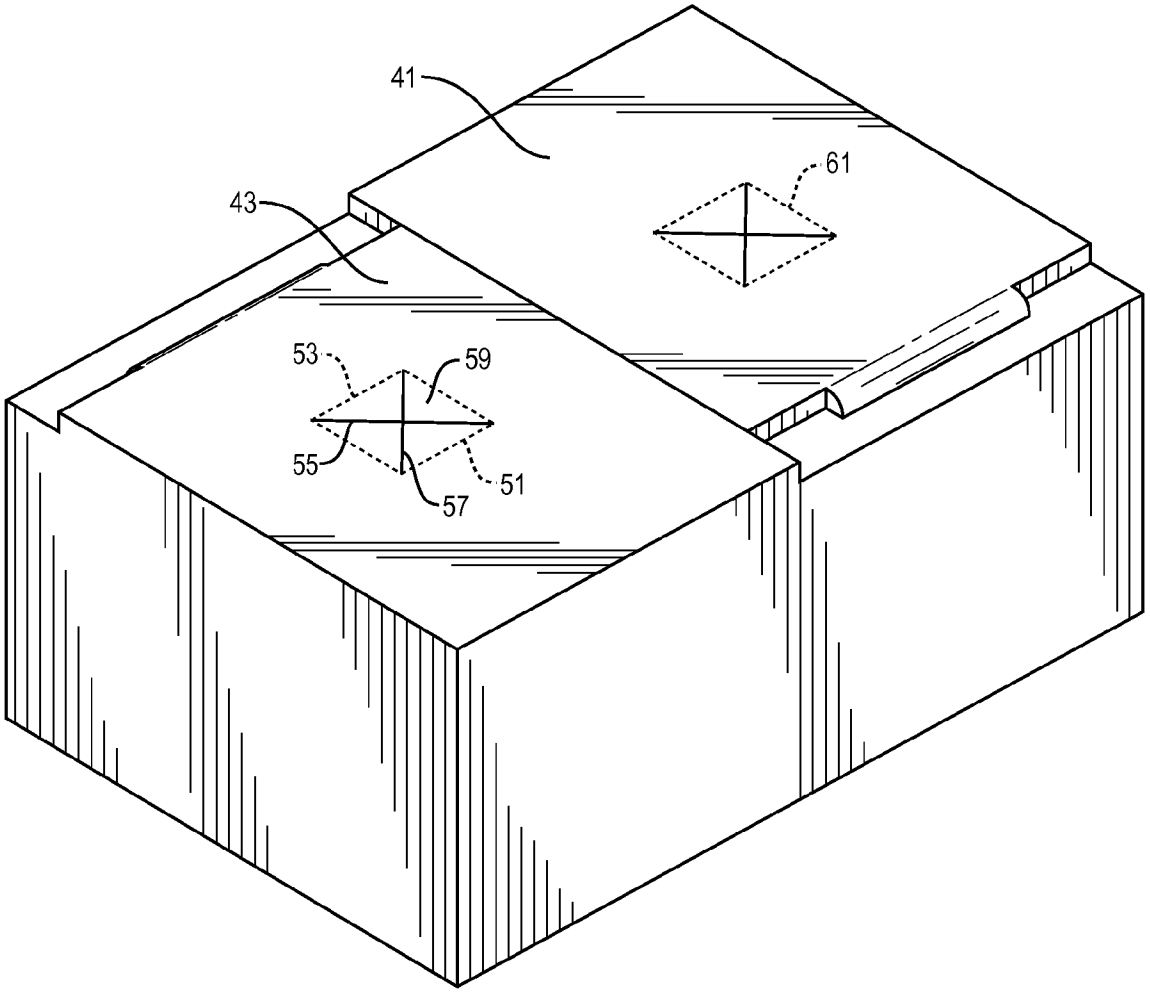
FIG. 4 is an orthographic view of the bottom and two sides of a building block, in an implementation of this invention.

FIG. 4 is an orthographic view of the bottom and two sides of the same building block. Two square apertures 51, 61 are on the bottom side of the block. Each of these square apertures is surrounded by four score lines, such as 53. In addition, each square aperture has two crisscrossing cuts, such as 55 and 57. These cuts 55, 57 and the score lines form four triangular tabs, e.g., 59, in each square aperture. When the triangular tabs are pushed up (bent at a sharp angle from the plane of the bottom of the block), the aperture appears as a square hole. The apertures 51, 61 are located on panels 43, 41, respectively.

Figure 5:
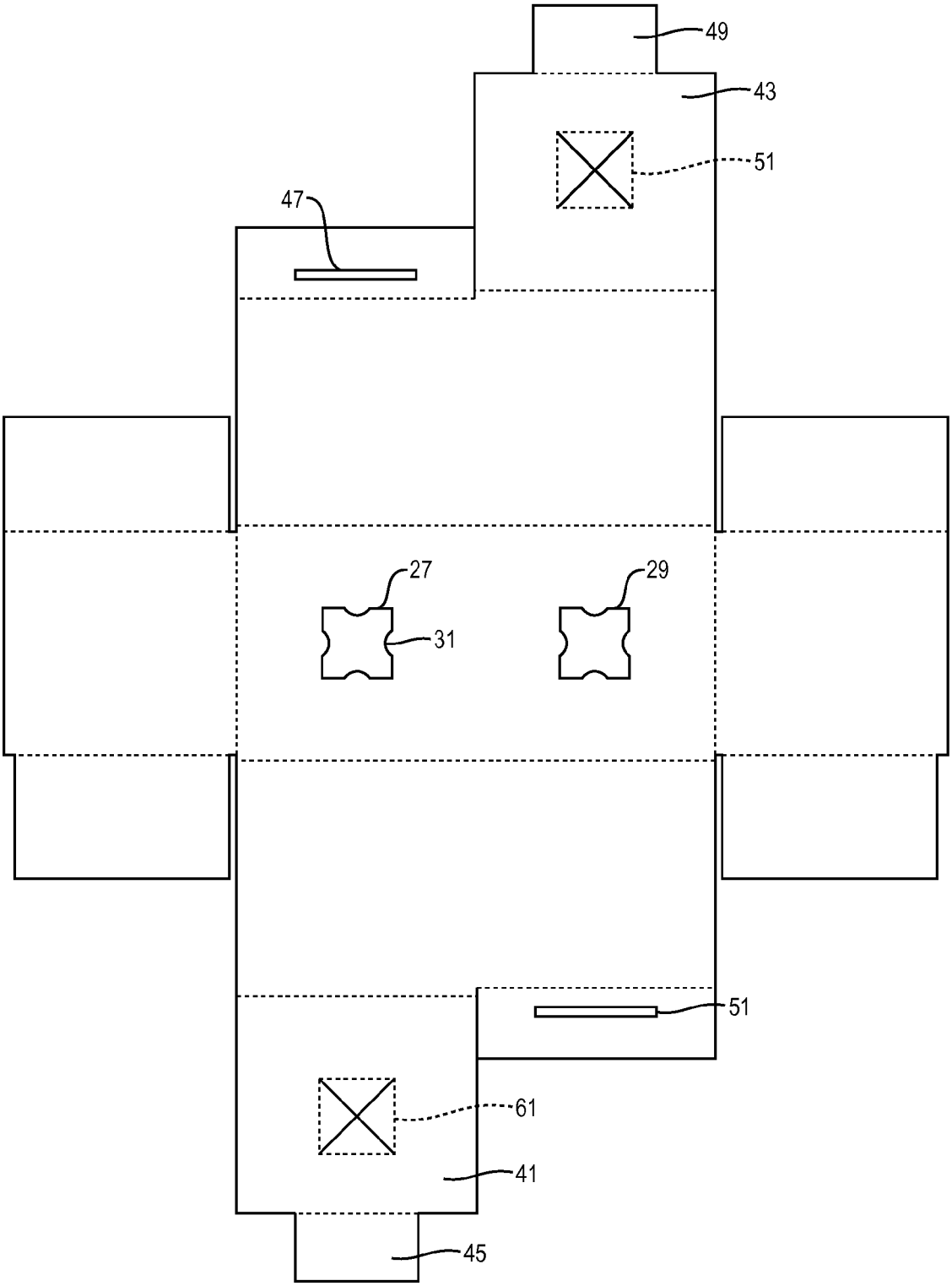
FIG. 5 is an orthographic view of a flat cardboard shape that is folded to make such a building block, in an implementation of this invention.

FIG. 5 is an orthographic view of a flat cardboard shape from which a building block may be folded, in an implementation of this invention. The top of two connectors may be inserted through holes 27 and 29. Tabs 45 and 49 may be inserted into slots 47 and 51, respectively.

Figure 6:
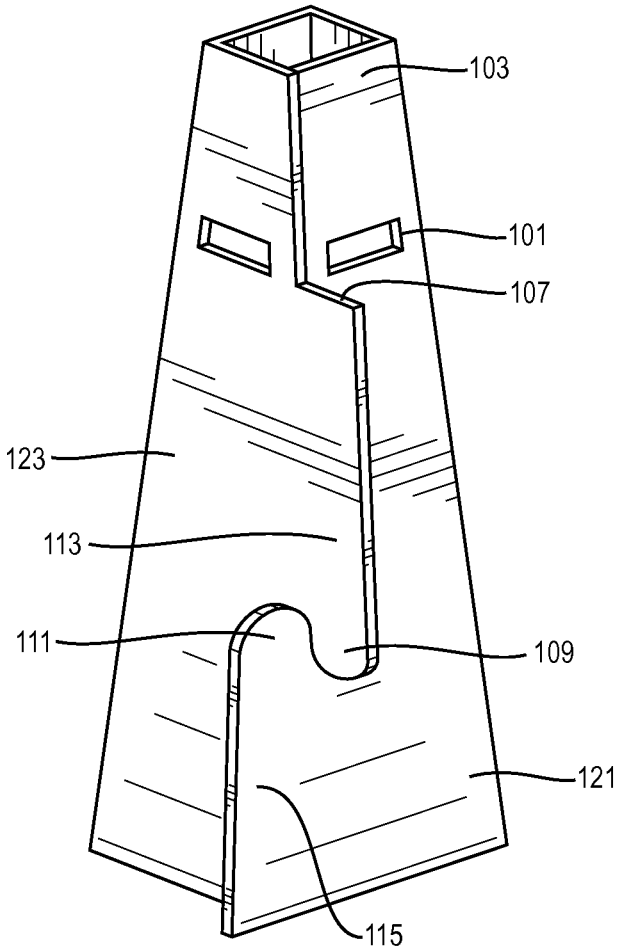
FIG. 6 is a perspective view of a connector, in an implementation of this invention. The connector generally has the shape of a truncated, four-sided pyramid.

FIG. 6 is a perspective view of a connector, in an implementation of this invention. The connector is generally a four-sided pyramid in shape. However, the top is truncated. The connector is made by folding a flat cardboard shape. Tabs 113 and 115 interlock with flaps 109 and 111. The top ledge 107 of tab 113 is underneath and supports the top side 21 of the building block (when the building block is folded so that it partially encloses the connector). The top portion of the connector projects through the top 21 of the building block, forming a nub 103. Tabs in the side of the hole, e.g., 31, fit into slots in the side of the connector, e.g., 101.

Figure 7:
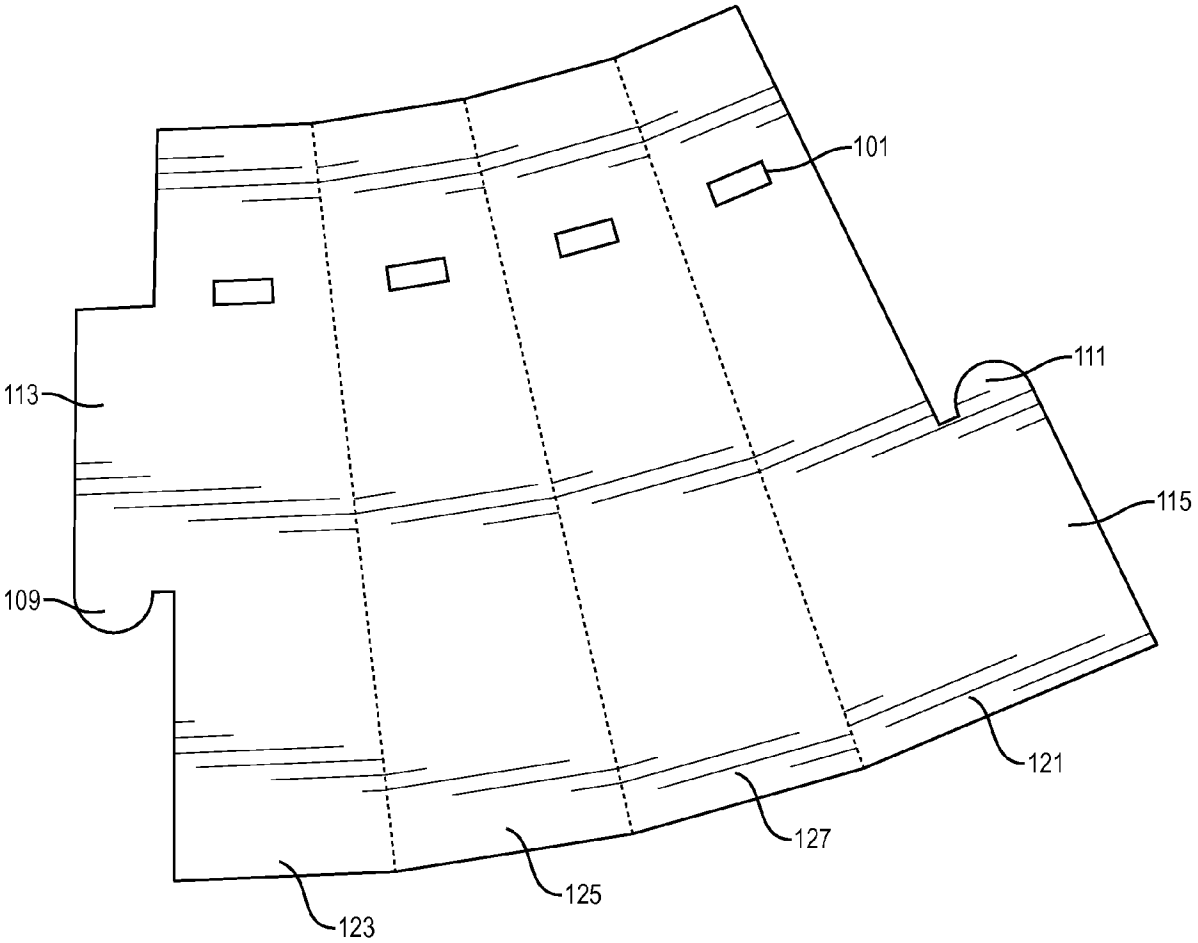
FIG. 7 is an orthographic view of flat cardboard shape that is folded to make such a connector, in an implementation of this invention.

FIG. 7 is an orthographic view of a flat sheet from which such a connector may be folded. The connector has four sides 121, 123, 125, 127.

In an exemplary implementation of this invention, a connector is rigidly attached to the building block in which it is partially enclosed. The connector cannot move lengthwise along its axis because, on the one hand, the tapered shape of the pyramidal connector prevents the larger base of the connector from protruding further out through the hole in the side of the block, and, on the other hand, the inner side of the bottom wall of the building block prevents the connector from moving further into the block. Also, the top ledge 107 of tab 113 of the connector restrains the connector from protruding further out of the hole. The fact that tabs on the edge of the hole, e.g. 31, are inserted into slots in the side of the connector, e.g. 101, also tends to restrain lengthwise movement along connector's axis. Side to side movement of the connector (or rotation about its axis) is prevented by the square shape of the hole through which the pyramidal connector snugly protrudes.

Figure 8:
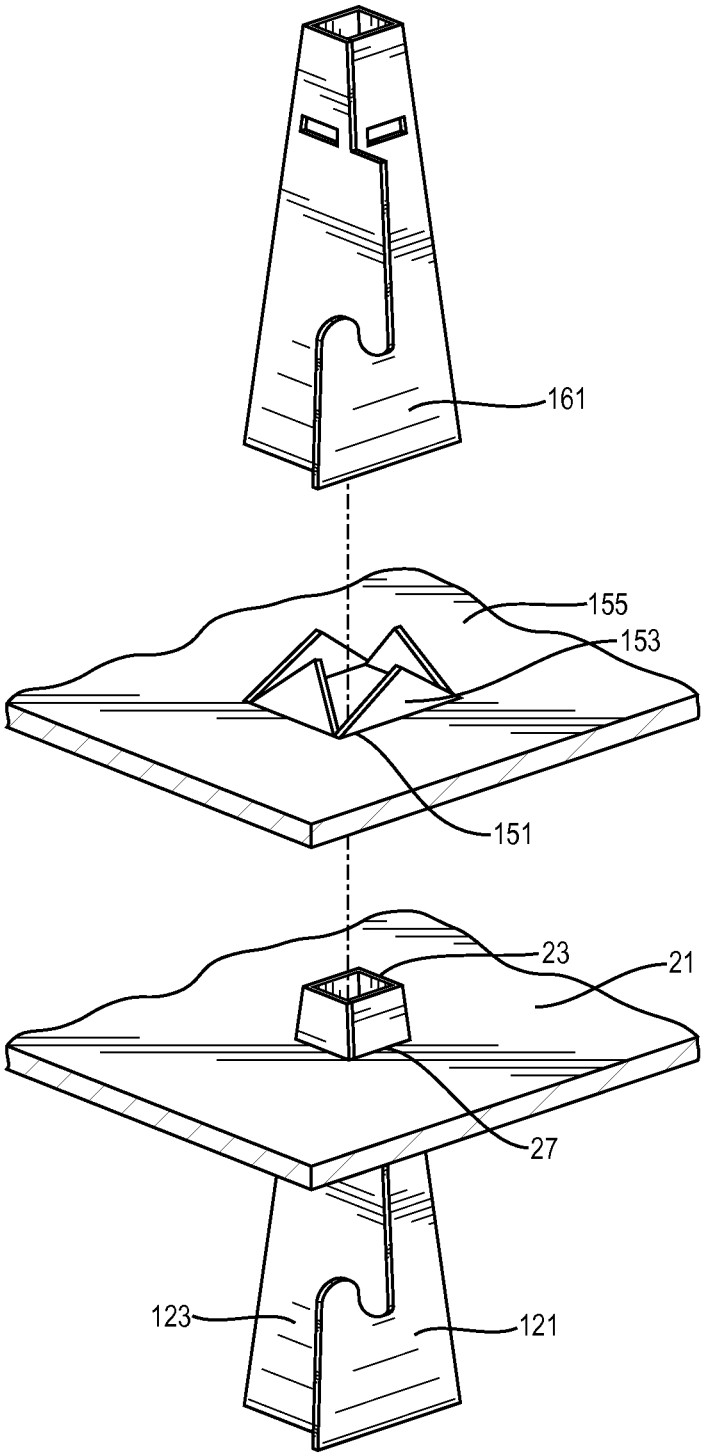
FIG. 8 is an exploded view of two connectors and parts of two building blocks, in an implementation of this invention.

FIG. 8 is an exploded view of two connectors and part of two building blocks, in an implementation of this invention. These fit together when a nub is inserted into a square aperture, as follows: The top part of a connector forms a nub 23 that projects through a hole 27 in the top 21 of a first building block. The bottom part of this first connector is enclosed in the first building block. When the nub of this first connector is inserted into a square aperture 151 in the bottom 155 of a second building block, four triangular tabs of that aperture, e.g. 153, are pushed up. These four triangular tabs are surrounded by the bottom inner wall of a second connector, 161. This second connector 161 is partially enclosed by the second building block. The bottom of the second connector 161 rests on the inner wall of the bottom 155 of the second building block, surrounding the triangular tabs, e.g. 153.

Figure 9:
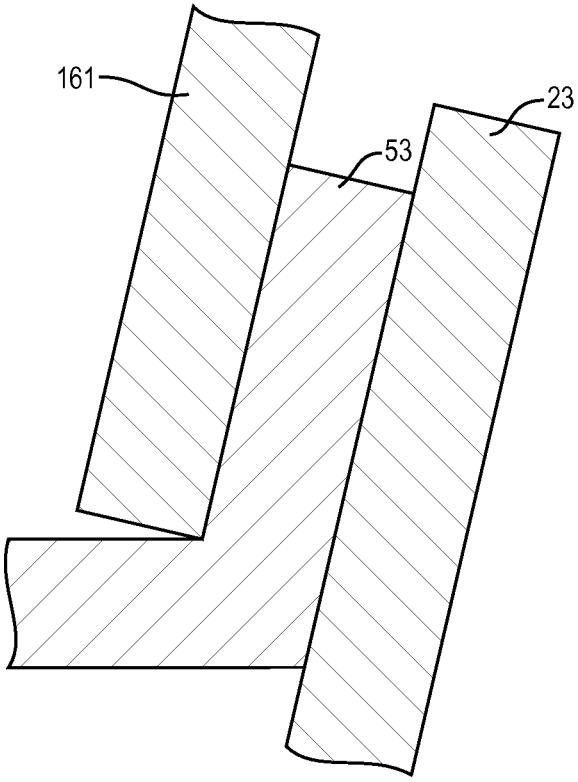
FIG. 9 is a cross-section of three layers of cardboard, in an implementation of this invention.

FIG. 9 is a cross-section that shows how three layers of cardboard are pressed against each other when a nub is inserted into a square aperture, in an implementation of this invention. The outer cardboard layer is part of a side of a connector 161. The middle layer is a triangular tab e.g., 153, in a square aperture of a building block (which block partially encloses connector 161). The inner layer is a side of a nub 23 projecting from another building block. In FIG. 9, the empty space in the middle of the nub is to the right of cardboard layer 23.

This novel arrangement of three layers of cardboard has the advantage that it increases the friction between the nub and the aperture into which it is inserted. This greater friction is due to both increased surface area and increased pressure. The triangular tabs increase the amount of surface area in contact with the nub (as compared to the small area that would be in contact if the tabs were absent and only the wall of the second block was in contact with the nub). Also, the triangular tab exerts more pressure than would a mere wall of the second block. This is because the bottom of the second connector 161 presses against the triangular tab 153, tending to prevent the tab 153 from deforming away from the nub 23.

This novel arrangement may be used to advantage to form a rigid but releasable connection between building blocks, in an implementation of this invention. When a nub is inserted into a square aperture, these three layers of cardboard are pressed snugly together, frictionally restraining the nub from lengthwise movement along its axis. Also, the matching square shape of the nub and the aperture prevent the nub from moving side-to-side or rotating about its axis.

Alternately: (1) the layer of corrugated board shown on the right side of FIG. 9 may be part of a protuberance, such as protuberance 210 shown in FIG. 10B, (2) the middle layer of corrugated board shown in FIG. 9 may be any tab adjacent to any hole, such as hole 206 in FIG. 10A, and (3) the layer of corrugated board shown on the left side of FIG. 9 may comprise one or more other objects.

Different size blocks may used in this invention. A larger block may be used to advantage for building a larger structure.

In some implementations of this invention, blocks of different sizes may be attached to each other. A simple way to achieve this is to keep the size of the nubs and apertures the same, regardless of the size of the block. In that case, a larger block may have more nubs and apertures than a smaller block, but the size of the nubs and apertures is constant. Another way to achieve this is to allow different size nubs and apertures on different blocks. For example, a large block could have large nubs and apertures, and a small block could have small nubs and apertures. In that case, a transition block may be used. The transition block would have smaller apertures on one side, and larger nubs on the other side, or vice versa.

Different types of material may be used in this invention. Corrugated cardboard is desirable for many implementations because of its light weight and low cost. However, other semi-rigid materials may be used, including corrugated plastic. Also, more than one type of material may be used in a single implementation of this invention.

This invention may be implemented as toy blocks for children. In an exemplary implementation of this invention, the blocks are made of folded cardboard, and are sufficiently large and strong that a child may use them to build a fort or house. These blocks may be light in weight, so that if they were to fall or be thrown, they would not injure a child.

Alternately, this invention may be implemented as blocks for use in constructing dividers, walls or furniture for office or home use.

Alternately, this invention may be implemented as blocks for use in constructing displays for trade shows.

Different shapes may be used for the connectors or apertures. For example, using a trilateral pyramidal connector and matching triangular apertures would facilitate joining blocks at angles other than right angles. Also, for example, using a conical or tubular connector and matching circular aperture would facilitate joinder of blocks in a manner that permits rotation.

Blocks may be in a variety of shapes, such as triangles and hexagons. Blocks of the same shape may be connected to each other. Alternately, blocks of different shapes may be attached to each other.

The number and arrangement of nubs on a building block may vary. For example, this invention may be implemented with two or three parallel rows of nubs.

In some implementations of this invention, corrugated cardboard is shipped to the end user in flat sheets or flat shapes, and then folded by the end user to make the building blocks and connectors.

Alternate approaches may be used to reduce permanent deformation of the parts used for interlocking. For example, an inelastic tape may be wrapped around the outside of the connector 161 that surrounds the triangular tabs 153. Also, for example, a more resilient material than corrugated cardboard may be used for the building blocks and connectors, which material would tend to elastically spring back better than cardboard. In addition, for example, a spring or springy material may be inserted into the middle, empty space of a nub, to cause the nub to tend to elastically spring back.

Alternate approaches may be used to simplify folding of building blocks and connectors.

For example, a connector may not include tabs 113, 115 and flaps 109, 111. Instead, sides 121 and 123 may be attached to each other by an adhesive or by tape.

In some embodiments of this invention, connectors may be folded from the same flat shape as the building block, rather than from a separate flat shape.

Figure 10A:
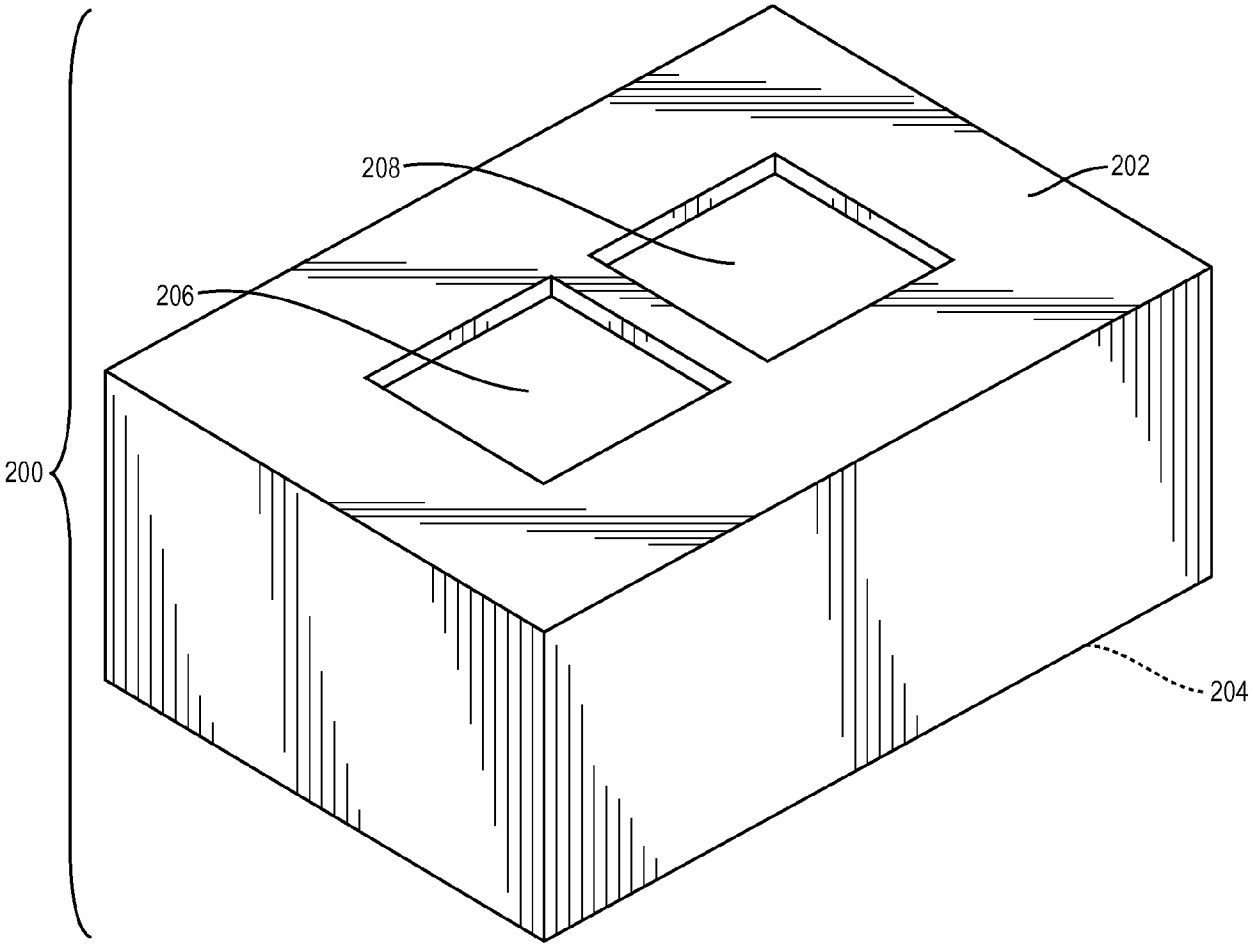
FIGS. 10A and 10B are two views of the same building block.
Figure 10B:
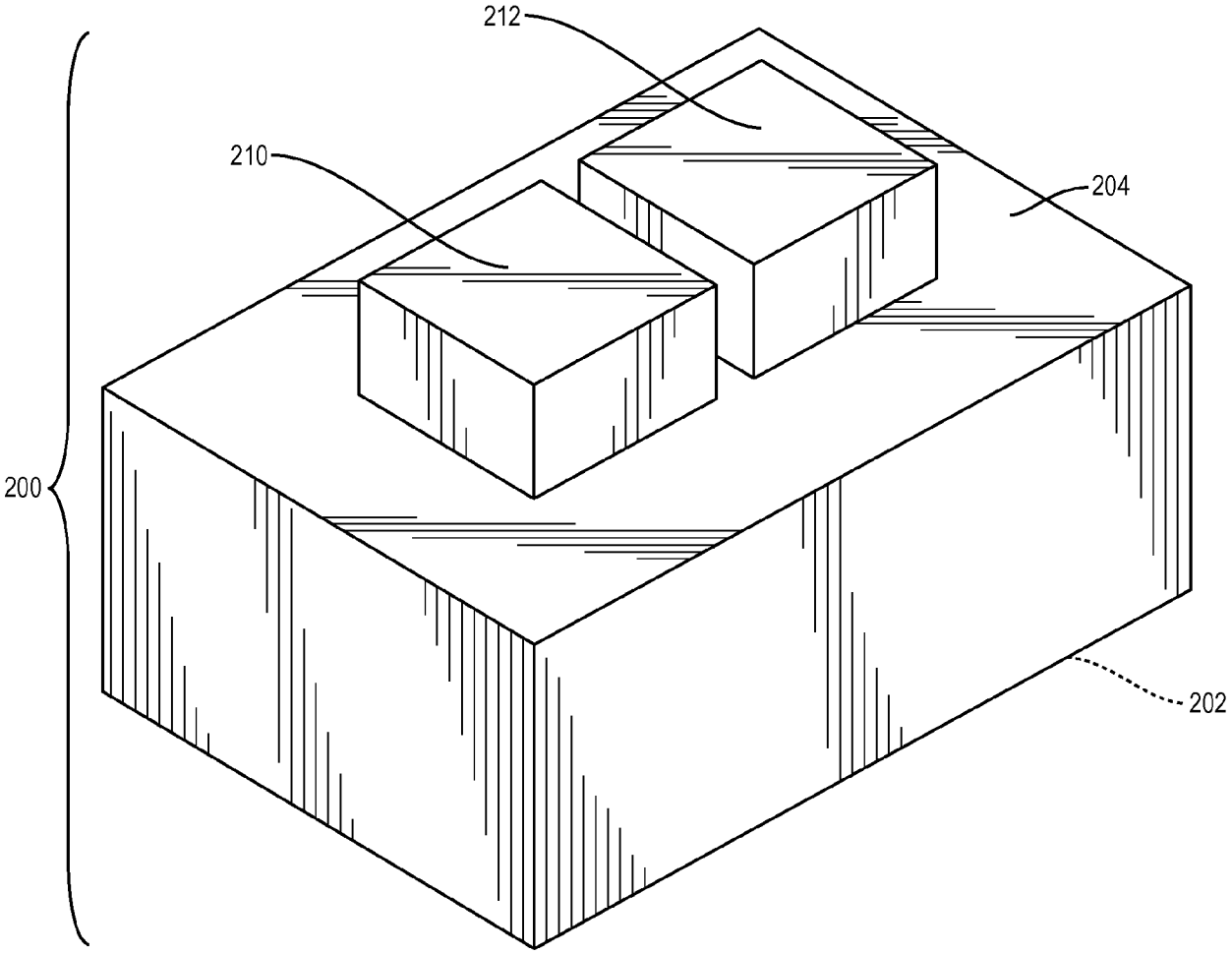

FIGS. 10A and 10B are two views of the same building block 200, in an illustrative implementation of this invention. FIG. 10A shows the bottom 202 of the block with two holes 206, 208 in it. FIG. 10B shows the top 204 of the same block with two protuberances 210, 212 on it. Two such blocks may be joined together by inserting the protuberances of one block into the holes of the other block. Details, such as tabs and folding, are not shown in FIGS. 10A and 10B This invention may be implemented in such a manner that all or part of the exterior of a building block is covered with graphics, text, decorations, photos or other images or designs. These may be printed directly on the cardboard, or instead printed on a sheet or layer of material that is used to cover all or part of exterior of the building block.

This invention may be implemented in such a way that photos and designs are printed on building blocks using large format printers. By stacking blocks, these photos or designs may be aggregated to make a larger pattern for a display or furniture. In this way, for example, one could produce a coffee table base with a picture of one's family or a graphic element. In such an implementation with a large format printer, a program may be used to place the graphic in the right place on the building block.

Similarly to Lego® plastic bricks, basic block structures can be combined with other elements, in an exemplary implementation of this invention. For example, basic blocks may be combined with pulleys, motors gears, wheels or other mechanical parts to produce mechanical and functional objects, such as cars and prototype mechanical structures or ad-hoc structures with mechanical capabilities.

This invention may be implemented in such a way that it has numerous advantages compared to Lego® plastic bricks. For example, in some embodiments, this invention may be manufactured using cheaper equipment and cheaper materials, and may be shipped in flat sheets.

In some embodiments of this invention, building blocks or elements of blocks (such as connectors, flaps or surfaces) may be glued or taped to together to make a structure stronger and more stable.

Like Lego® plastic bricks, this invention may be implemented in such a way that any number of different shapes can be formed and mated or used with special-purpose features. Here are four examples, in illustrative embodiments of this invention. First, such a special-purpose feature may be a sheet of cardboard adapted to act as a roof or wall. Second, a sheet with an opening or clear material may be used for a window. Third, there can be parts like doors. Fourth, there may be plastic or cardboard pieces representing people or animals. In illustrative embodiments the design can also use endorsements such as Disney® or Star Wars®.

This invention may be implemented in many different ways. For example:

This invention may be implemented as a method of releasably connecting building blocks, comprising, in combination: (a) inserting a first protuberance from or of a first building block into a hole in a wall of a second building block, thereby pushing back tabs of the wall so that the tabs compress the first protuberance, and (b) compressing the tabs with one or more other objects. Furthermore: (1) the building blocks, tabs and protuberances may each comprise primarily, by weight, corrugated board; (2) the one or more other objects may comprise the walls of a second protuberance; (3) the first and second protuberances may each have a main body, which main body is a tapered polyhedron, and (4) the first protuberance may have an end that is inserted into the hole, and that end may be circular or regular polygonal in shape.

This invention may be implemented as corrugated board that is cut and scored for folding into a building system, which building system comprises a plurality of blocks, wherein: (a) at least some of the blocks have a main body that is a rectangular cuboid in shape, (b) each of the blocks has a top side and a bottom side, with protuberances positioned in a rectangular array on the top side and holes positioned in a rectangular array on the bottom side, (c) the protuberances on the top side are each circular or equiangular polygonal in cross-sectional shape and the holes on the bottom side are each the same cross-sectional shape as the protuberances, (d) each of the blocks and protuberances primarily comprises, by weight, corrugated board, (e) at least one pair of blocks in the plurality of the blocks, which pair comprises a first block and a second block, may be releasably connected by inserting the protuberances on the top of the first block into the holes in the bottom of the second block. Furthermore: (1) each protuberance that is so inserted into a hole may displace tabs adjacent to that hole, which tabs may compress that protuberance, (2) the tabs that compress a protuberance may in turn be compressed by one or more other objects, (3) the corrugated board may have already been folded into the building system, (4) all or part of the exterior of at least some of the blocks may be covered with graphics, text or photographs, (5) the main body of each block and the protuberances on the top side of that block may be integral parts of the same monolithic piece of corrugated board, (6) the main body of each block may be separate from the protuberances of that block, which protuberances may be releasably attachable to the main body of that block, (7) the building system may include objects comprising material other than corrugated board, which objects are mechanically moveable parts such as gears, chains or pulleys, and (8) the corrugated board may comprise corrugated cardboard or corrugated plastic.

This invention may be implemented as corrugated board that is cut and scored for folding into a building system that comprises a plurality of blocks and connectors, wherein: (a) each of the blocks and connectors comprise primarily, by weight, corrugated board, (b) each of the blocks has a main body that is rectangular cuboid in shape, (c) each of the blocks has a top side and a bottom side, with top holes on the top side and bottom holes on the bottom side, (e) each connector has a main body that is a tapered polyhedron, (d) each connector has a narrow end and a broad end, positioned at the respective ends of that connector's longitudinal axis, and (f) at least one pair of the blocks in the plurality of the blocks, which pair comprises a first block and a second block, may be connected by aligning at least some of the bottom holes of the second block with at least some of the top holes of the first block, and inserting the narrow end of at least some of the connectors into holes that are so aligned, one connector per pair of holes that are so aligned. Furthermore: (1) for each narrow end that is so inserted into holes that are so aligned, the narrow end may displace tabs adjacent to at least one of the holes that are so aligned, which tabs may compress that narrow end; (2) for each narrow end that is so inserted into holes that are so aligned, the tabs that compress that narrow end may in turn be compressed by one or more other objects, (3) the one or more other objects may comprise, at least in part, walls of a different connector, (4) all or part of the corrugated board may be covered with graphics, text or photographs, and (5) the building system may include objects comprising a material other than corrugated board.

As used herein, the term "rectangular array" means an array of items spatially located in one or more rows and one or more columns, wherein the one or more rows are perpendicular to the one or more columns, the distance between items in each of the rows is constant, and the distance between items in each of the columns is constant.

CONCLUSION

It is to be understood that the methods and apparatus which have been described above are merely illustrative applications of the principles of the invention. Numerous modifications may be made by those skilled in the art without departing from the scope of the invention. The scope of the invention is not to be limited except by the claims that follow.

What is claimed is:

1. A system, comprising:

corrugated board, said corrugated board is folded, or is configured by cuts and scores to be folded, into at least a plurality of blocks, said corrugated board comprising at least one of corrugated cardboard and corrugated plastic, wherein:

(a) each block, out of the plurality of blocks, includes (i) a main body that is rectangular cuboid in shape, (ii) a rectangular array of protuberances on a side of the main body, said protuberances are equiangular polygonal in cross-sectional shape and comprise corrugated board, and (iii) a rectangular array of holes in another side of the main body;

(b) the plurality of blocks are releasably connected to each other, each respective connection being by insertion of the protuberances of one of the plurality of blocks into the holes of one or more other blocks, wherein the protuberances of each respective block, out of the plurality of blocks, are not part of and are releasably connected to the main body of the respective block; and (c) the plurality of blocks are configured in such a manner that, when specified blocks, out of the plurality of blocks, are releasably connected to each other, a first layer of corrugated board is positioned between and compressed by a second layer of corrugated board and a third layer of corrugated board.

2. The system of claim 1 wherein, when a specific protuberance is inserted into a specific hole, the specific protuberance displaces tabs adjacent to the specific hole and the tabs compress the specific protuberance.

3. The system of claim 1, wherein the first, second and third layers are each respectively part of a different integral structure that includes only one of the first, second and third layers.

4. The system of claim 3, wherein the first layer of corrugated board is a tab of the main body of one of the plurality of blocks.

* * * * *